US005119431A

United States Patent [19]

Hamby

[11] Patent Number: 5,119,431

[45] Date of Patent: Jun. 2, 1992

[54] EFFICIENCY LOUDSPEAKER

[76] Inventor: William H. Hamby, 1394 Del Sol La., San Diego, Calif. 92154

[21] Appl. No.: 138,081

[22] Filed: Dec. 28, 1987

[51] Int. Cl.[5] ..... H04R 25/00

[52] U.S. Cl. ..... 381/195; 381/201; 381/89

[58] Field of Search ..... 381/195, 199, 182, 89, 381/197, 201, 200

[56] References Cited

U.S. PATENT DOCUMENTS 2,926,221 2/1960 Kagdis ..... 381/195
4,472,605 9/1984 Klein ..... 381/195 X
4,914,707 4/1990 Kato et al. ..... 381/86

*Primary Examiner*—Forester W. Isen

[57] ABSTRACT

An improved efficiency loudspeaker that increases the accoustical output of the speaker by increasing its amplitude without increasing the power input to the speaker. This is accomplished by doubling the amplitude of displacement of a speaker diaphragm. The sound power of the speaker is thus increased by a factor of four. This is accomplished by utilizing a pair of voice coils which are reverse wired to each other so that both voice coils drive the diaphragm speaker. Thus, one voice coil pushes the diaphragm while the other pulls the diaphragm. This essentially doubles the acceleration of the diaphragm, therefore, doubling the velocity per unit time and thereby doubling the amplitude displacement per unit time. An even more efficient configuration is obtained by using two sets of these wired in parallel where sound power is increased 8 (eight) to 10 (ten) times.

7 Claims, 2 Drawing Sheets

FIG. 6
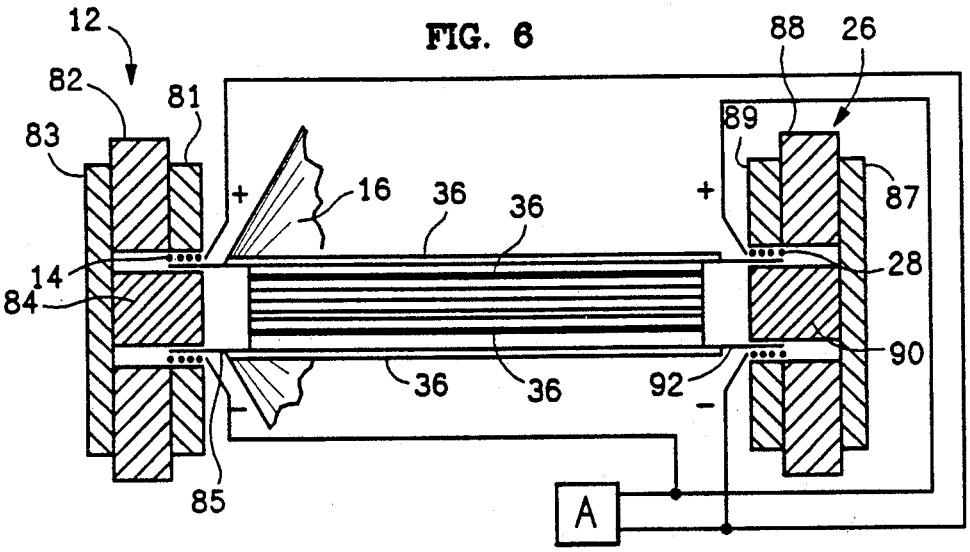
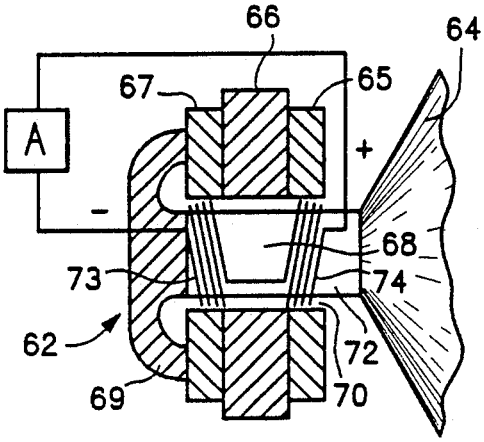
FIG. 7
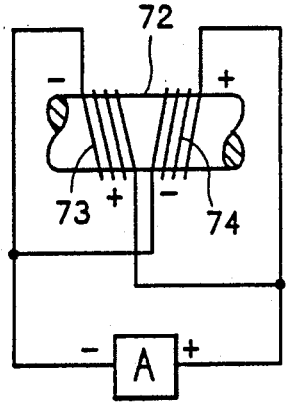
FIG. 8
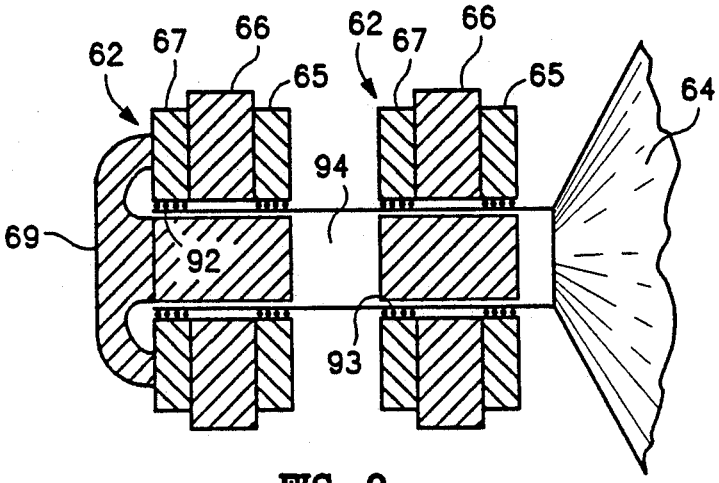
FIG. 9

EFFICIENCY LOUDSPEAKER

BACKGROUND OF THE INVENTION

The invention relates to a speaker for a sound system and more specifically to an improved efficiency loudspeaker which has its amplitude increased without increasing the power input to the speaker.

In the past in order to increase the amount of sound produced by a speaker it has been necessary to increase the number of watts of power input to the speaker. Also in instances where speakers are being used for a live performance such as in an arena or in an outside stage area, it is necessary that a high level of sound be produced so that the audience at the concert can hear the performance even while seated at remote distances from the stage. Since the cost of a speaker increases dramatically from a 100 watt speaker to a 300 watt or greater speaker, most of the concert performances require a large number of speakers to be utilized, sometimes as many as forty or more.

It is an object of the invention to produce a novel high efficiency loudspeaker that is capable of producing a greater level of sound per amount of watts of power input than is presently available from state of the art loudspeakers.

It is also an object of the invention to provide a novel high efficiency loudspeaker that will allow for the elimination of as many as eight out of every ten loudspeakers now required for musical concert presentations.

It is another object of the invention to provide a novel high efficiency loudspeaker that has a Di-Polar Push Pull speaker System.

It is an additional object of the invention to provide a novel high efficiency loudspeaker that is economical to manufacture and market.

SUMMARY OF THE INVENTION

Applicant's novel high efficiency loudspeaker greatly increases the amount of sound produced from a comparably sized loudspeaker without increasing the number of watts of power input. This increase in the sound has been produced by taking a standard sized speaker having a speaker magnet and a voice coil and adding a second voice coil to the loudspeaker. The positive lead of one of the voice coils is connected to the negative lead of the other voice coil and likewise the negative lead of the first voice coil is connected to the positive lead of the second voice coil. The two voice coils are preferably supported as closely as possible to each other. The positive lead of the first voice coil is connected to the positive terminal of an amplifier used with the loudspeaker and the negative lead of the first voice coil is connected to the negative lead of the amplifier. The effect produced by this arrangement results in the first voice coil functioning to push the amplitude of the speaker's diaphragm in one direction and the second voice coil acts to "pull" the diaphragm of the speaker in that same direction. This essentially doubles the acceleration of the diaphragm, hence doubling the velocity per unit time and thereby doubling the amplitude displacement per unit of time.

The advantages of applicant's novel increased efficiency loudspeaker is six decibels (6 db) or four times the efficiency of energy conversion, that is electrical to accoustical, and a surface area intensity increase of 6 db or 4 times.

Two sets run in parallel (a more advantageous configuration) will double the efficiency once again so that an 8 times increase in efficiency is obtained but since this doubles the effective surface area, the surface intensity is still increased 4 times.

The original speaker diaphragm intensity is therefore increased 6 db, with one speaker thus being able to produce the sound output of 4 previous speakers. This would reduce the need for an average of 60 full sized public address speakers at stadium and arena concerts to 15 full sized speakers. Also quite important is the fact this would also reduce the need for amplifiers from 30 to 7 or 8 which would be a significant savings in cost. Further reductions in cost would result from the reduced number of people that would need to be hired to move all of the above mentioned equipment, both for setting up the sound system and for after concert removal of the sound system. The cost of adding an additional voice coil and magnet to a standard loudspeaker would be minimal as compared to the savings produced.

The novel Di Polar Push Pull type of design will work with essentially any normal electro-magnetic or dynamic design type speaker, regardless of size, large or small. The overall quality is not a requirement either, although more benefit will occur with higher quality, professional sound reinforcement speakers.

The purpose of the voice coil, magnet, front and back plates is to orient the voice coil so that when an electric current is caused to flow thru the voice coil the voice coil and magnet are repulsed away from each other, (traditional form).

In the Di-Polar Push-Pull arrangement one voice coil is traditionally oriented. The other voice coil is oriented oppositely so that when an electric current is caused to flow thru the voice coil, the voice coil and magnet are "attracted" to each other.

DESCRIPTION OF THE DRAWINGS

FIG. 6 is a cross sectional view of the magnets and voice coils of the high efficiency loudspeaker illustrated in FIG. 1;

FIG. 7 is a cross sectional view of the magnet and voice coils of the third alternative version of the high efficiency loudspeaker illustrated in FIG. 4;

FIG. 8 is an electrical diagram of an alternative version of the voice coils that could be used with the loudspeaker illustrated in FIG. 7; and FIG. 9 is a cross sectional view of the magnets and voice coils of the second alternative version of the high efficiency loudspeaker illustrated in FIG. 3.

DESCRIPTION OF THE PREFERRED EMBODIMENT

Figure 1:
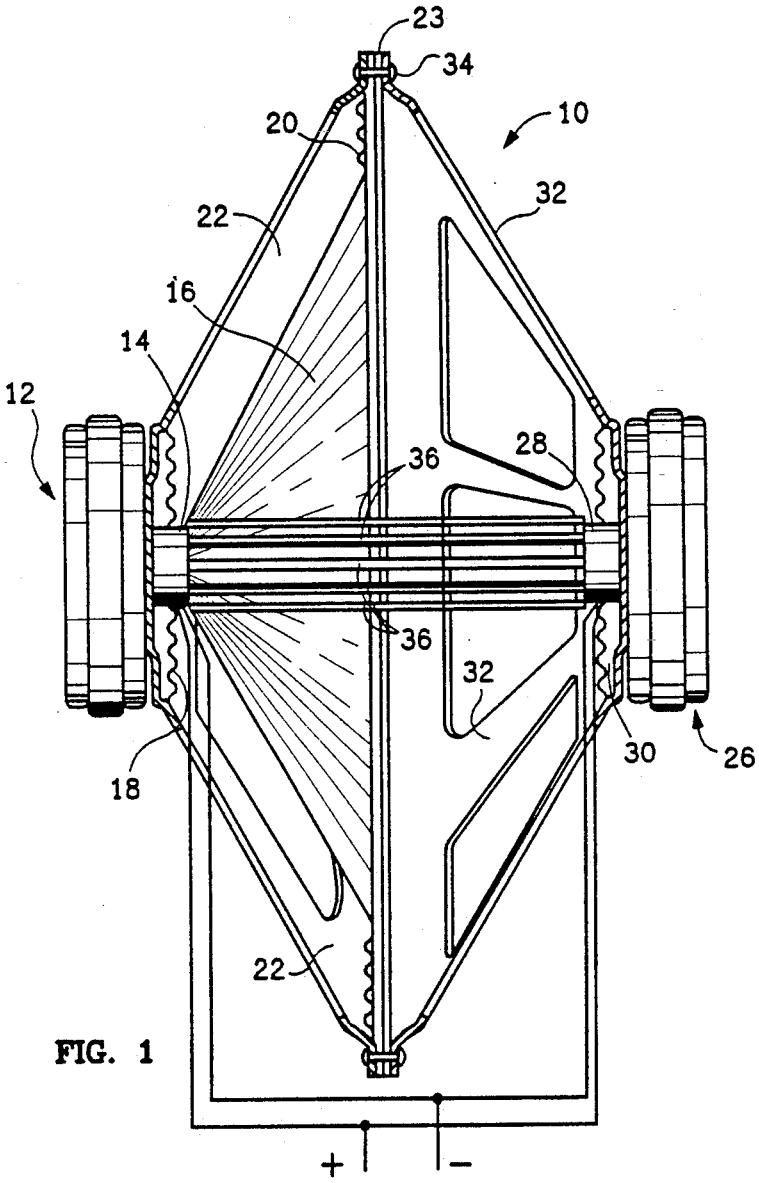
FIG. 1 is a schematic illustration of applicant's novel high efficiency loudspeaker.

Applicant's novel high efficiency loudspeaker will now be described by referring to FIGS. 1-9 of the drawings. The loudspeaker is generally designated numeral 10.

Loudspeaker 10 has a first speaker magnet assembly 12, a voice coil 14 and a speaker diaphragm 16. The bottom end of the diaphragm 16 has a spider surround suspension 18. The top end of the diaphragm 16 has a spider surround suspension 20. A plurality of support frame struts 22 have their bottom ends connected to speaker magnet assembly 12 and their top ends connected to a frame 23.

A second speaker magnet assembly 26 has a second voice coil 28. Voice coil 28 has a spider surround suspension structure 30 but, the spider structure may not be necessary if the loudspeaker is precision manufactured. A plurality of support frame struts 32 have their top end connected to speaker magnet 26 and their bottom end connected to frame 23 by fasteners 34. A plurality of coil columnades 36 function to support voice coil 14 in relation to voice coil 28. These have been made from balsa wood material but other materials (low density, high strength) would also be acceptable. The closer together that the voice coils can be positioned, the better.

The positive lead of voice coil 14 is connected to the negative lead of voice coil 28 and the negative lead of voice coil 14 is connected to the positive lead of voice coil 28. The positive lead of voice coil 14 would be connected to the positive lead of an amplifier to be used with the speaker. Also the negative lead of voice coil 14 would be connected to the negative lead of that amplifier. By electrically connecting a pair of the loudspeakers 10 in parallel an even greater efficiency (power in vs. power out) would be produced.

Figure 2:
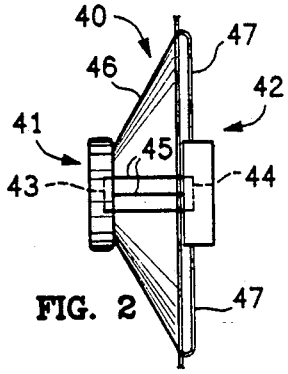
FIG. 2 is a schematic illustration of a first alternative version of applicant's novel high efficiency loudspeaker.

A first alternative embodiment is illustrated in FIG. 2 and this high efficiency loudspeaker is generally designated numeral 40. It has a first speaker magnet assembly 41 and a second speaker magnet assembly 42. First voice coil 43 is supported from voice coil 44 by a plurality of coil columnades 45. The speaker diaphragm 46 would be supported in a similar manner to that illustrated in FIG. 1. A plurality of strut arms 47 would also he used to help support magnet assembly 42. Again the voice coils of speaker 40 would have their positive and negative terminals connected in the same manner as illustrated in FIG. 1.

Figure 3:
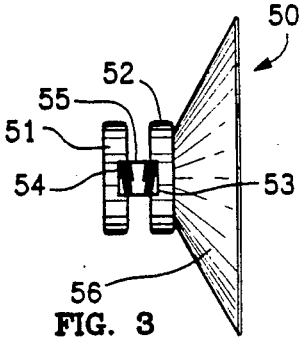
FIG. 3 is a schematic illustration of a second alternative version of applicant's high efficiency loudspeaker.

A second alternative high efficiency speaker is illustrated in FIG. 3 and it is generally designated numeral 50. It has a first speaker magnet assembly 51 and a second speaker magnet assembly 52. Voice coil 53 is supported a fixed distance from voice coil 54 by the former 55 of voice coil 53. A speaker diaphragm 56 would extend from one side of speaker magnet assembly 52. The positive and negative leads of speaker 50 would be connected to each other in the same manner as that which is illustrated in FIG. 1.

Figure 4:
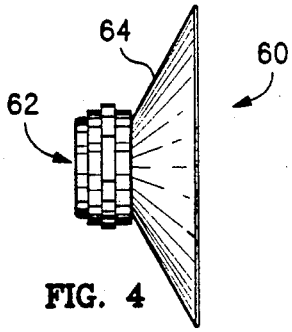
FIG. 4 is a schematic illustration of a third alternative version of applicant's high efficiency loudspeaker.

A third alternative high efficiency speaker is illustrated in FIG. 4 and it is generally designated numeral 60. It has a speaker magnet assembly 62 whose internal construction is best understood by referring to FIG. 7. Speaker magnet assembly 62 has a front plate 65, a magnet 66, a rear plate 67, a pole piece 68. Pole piece 68 is mounted in a fixed position within members 65, 66, and 67 by a support plate 69. There is a gap 70 between pole piece and the aligned bore holes of members 65, 66, and 67. A cylindrical former 72 telescopes over pole piece 68 and it has voice coils 73 and 74 wound thereon. Voice coils 73 and 74 are formed on a single length of wire but one coil is wound clockwise and the coil is wound counterclockwise. The negative lead of voice coil 73 is connected to amplifier A. The positive lead of voice coil 74 is also connected to amplifier A and when current is passed through the voice coils, one voice coil will function as a puller to cause former 72 and diaphragm 64 to reciprocate back and forth. The voice coil structure illustrated in FIG. 8 could be substituted for that used in FIG. 7. In FIG. 8 two separate lengths of wire are used instead of a single length of wire and their respective positive and negative leads are connected to amplifier A in the manner illustrated.

Figure 5:
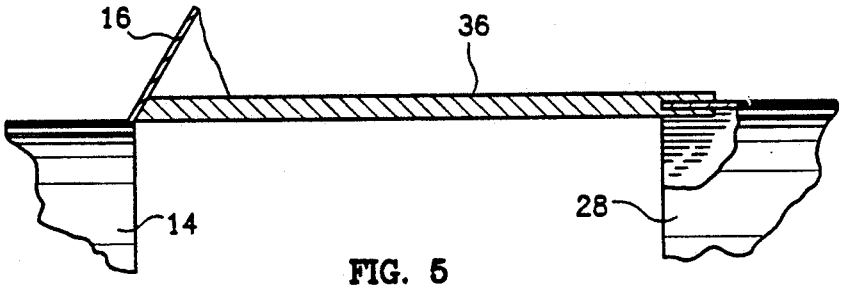
FIG. 5 is a partial view of the struts that connect the first and second voice coils of the embodiment illustrated in FIG. 1.

FIG. 5 is a partial illustration of the manner in which voice coil 14 is supported a fixed distance from voice coil 28. The coil columnades 36 have a slot formed in one of their ends that engages the round housing of voice coil 28. The opposite end of columnade 36 is glued to the inner surface of speaker diaphragm 16.

FIG. 6 illustrates the manner in which the voice coils of the embodiment shown in FIGS. 1,2 and 5 function together. First speaker magnet assembly 12 has a front plate 81, a magnet 82, a rear plate 83 and a pole piece 84. Voice coil 14 is mounted on former 85 which is free to reciprocate axially in response to electric current passing through the voice coil. It is this motion that produces the amplitude vibrations of diaphragm 16. Second speaker magnet assembly 26 has a front plate 87, a magnet 88, a rear plate 89 and a pole piece 90. Voice coil 28 is mounted on former 92 which is free to reciprocate axially in response to electric current passing through the voice coil. Voice coil 14 acts as the pushing member and voice coil 28 acts as the pulling member.

The high efficiency loudspeaker illustrated in FIG. 9 is formed from a pair of speaker magnet assemblies 62 having their voice coils 92 and 93 mounted on the same former 94. The use of an extra speaker magnet 62 doubles the efficiency of using only a single speaker magnet assembly.

The underlying foundation to all of the applicant's speaker designs is that there is more than one magnetic field in which the coil or coils are immersed, whereas all conventional speakers have only one magnetic field in which to immerse the coil.

What is claimed is:

1. An improved efficiency loudspeaker comprising:

a primary speaker diaphragm;

a first speaker magnet having a front plate and a rear plate;

a first voice coil wound on a coil form that functions as a pushing member for said primary speaker diaphragm, said first voice coil having a positive lead and a negative lead, said first voice coil, said first speaker magnet and its front and rear plates being so oriented that when an electric current is caused to flow through said first voice coil said first voice coil and said first speaker magnet are repulsed away from each other;

means for supporting said primary speaker diaphragm adjacent the front plate of said first speaker magnet;

a second speaker magnet having a front plate and a rear plate;

a second voice coil wound on a coil form that functions as a pulling member for said primary speaker diaphragm and it has a top end and a bottom end, the top end of said second voice coil being positioned within an aperture formed in the rear plate of said second speaker magnet at a predetermined position, said second voice coil having a positive lead and a negative lead;

means for supporting said second voice coil with respect to said first voice coil; and the positive lead on said first voice coil is electrically wired to the negative lead of said second voice coil and the negative lead on said first voice coil is electrically wired to the positive lead of said second voice coil, when said loudspeaker is connected to an amplifier, the positive lead of said first voice coil would be electrically wired to the positive lead of the amplifier and the negative lead of said first voice coil would be electrically wired to the negative lead of the amplifier.

2. An improved efficiency loudspeaker as recited in claim 1 wherein said first voice coil is positioned in an aperture formed in said first speaker magnet and its front plate and said second voice coil is positioned in an aperture formed in said second speaker magnet and its rear plate.

3. An improved efficiency loudspeaker as recited in claim 1 wherein said means for supporting said primary speaker diaphragm comprises a frame for supporting a top end of said loudspeaker and at least one support strut having its top end connected to said frame and its bottom end connected to said first speaker magnet.

4. An improved efficiency loudspeaker as recited in claim 1 wherein said means for supporting said second voice coil comprises at least one balsa wood strut having its opposite ends connected to said respective first and second voice coils.

5. An improved efficiency loudspeaker comprising:

a primary speaker diaphragm;

a first speaker magnet having a front plate and a rear plate;

a first voice coil wound on a coil form that functions as a pushing member for said primary speaker diaphragm, said voice coil having a positive lead and a negative lead, said first speaker magnet and its front and rear plates being so oriented that when an electric current is caused to flow to said first voice coil, said voice coil and said first speaker magnet are repulsed away from each other;

a second speaker magnet having a front plate and a rear plate;

a second voice coil wound on a coil form that functions as a pulling member for said primary speaker diaphragm and it has a top end and a bottom end, the top end of said second voice coil being positioned within an aperture formed in the rear plate of said second speaker magnet at a predetermined position, said second voice coil having a positive lead and a negative lead;

means for supporting said second voice coil with respect to said first voice coil;

the positive lead on said first voice coil is electrically wired to the negative lead of said second voice coil and the negative lead on said first voice coil is electrically wired to the positive lead of said second voice coil, when said loud speaker is connected to an amplifier, the positive lead of said first voice coil would be electrically wired to the positive lead of the amplifier and the negative lead of said first voice coil would be electrically wired to the negative lead of the amplifier;

means for supporting said primary speaker diaphragm adjacent the front plate of said second speaker magnet; and said first voice coil being positioned in a bore hole formed in the front plate of said first speaker magnet and said second voice coil is positioned in a bore hole formed in the rear plate of said second speaker magnet.

6. An improved efficiency loudspeaker comprising: a first speaker diaphragm having a front face and a rear face;

a first set of two voice coils wound on the same cylindrical former that is itself connected to said first speaker diaphragm;

means for producing from each of said voice coils of said first set a displacement of said first speaker diaphragm in the same direction comprising a single magnet with a top plate and a bottom plate, aligned bore holes are formed in said respective magnet and its top and bottom plates, said voice coils on said cylindrical former being positioned in said aligned bore holes so that one of said voice coils functions as a pushing member for said first speaker diaphragm and the other of said voice coils functions as a pulling member for said first speaker diaphragm;

a second set of two voice coils connected to said first set of voice coils so that they move as one set of voice coils; and means for producing from each of said voice coils of said second set a displacement of said speaker diaphragm in the same direction produced by said first set of voice coils.

7. An improved efficiency loud speaker as recited in claim 6 wherein said first set of two voice coils comprises a single length of electrically conductive wire that has a first portion coiled in a clockwise direction and a second portion coiled in a counter-clockwise direction.

* * * * *